US010215378B2

(12) United States Patent
Kinnune et al.

(10) Patent No.: US 10,215,378 B2
(45) Date of Patent: Feb. 26, 2019

(54) LIGHT FIXTURE

(71) Applicant: Cree, Inc., Durham, NC (US)

(72) Inventors: Brian L. Kinnune, Racine, WI (US); David P. Goelz, Milwaukee, WI (US)

(73) Assignee: Cree, Inc., Durham, NC (US)

( * ) Notice: Subject to any disclaimer, the term of this patent is extended or adjusted under 35 U.S.C. 154(b) by 557 days.

(21) Appl. No.: 13/838,479

(22) Filed: Mar. 15, 2013

(65) Prior Publication Data

US 2014/0119036 A1 May 1, 2014

Related U.S. Application Data

(60) Provisional application No. 61/624,211, filed on Apr. 13, 2012.

(51) Int. Cl.

| | |
|---|---|
| ***F21V 14/00*** | (2018.01) |
| ***F21V 21/00*** | (2006.01) |
| ***F21V 21/26*** | (2006.01) |
| ***F21V 29/00*** | (2015.01) |
| ***F21S 8/08*** | (2006.01) |
| ***F21V 29/507*** | (2015.01) |
| ***F21V 29/77*** | (2015.01) |
| ***F21V 29/83*** | (2015.01) |
| *F21W 111/02* | (2006.01) |
| *F21V 21/14* | (2006.01) |

(Continued)

(52) U.S. Cl.

CPC ..... *F21V 21/00* (2013.01); *F21S 8/086* (2013.01); *F21V 21/26* (2013.01); *F21V 29/004* (2013.01); *F21V 29/507* (2015.01); *F21V 29/77* (2015.01); *F21V 29/83* (2015.01); *F21V 15/013* (2013.01); *F21V 21/14* (2013.01); *F21W 2111/02* (2013.01); *F21W 2131/103* (2013.01); *F21Y 2105/10* (2016.08); *F21Y 2115/10* (2016.08)

(58) Field of Classification Search

CPC ..... F21V 15/013; F21V 21/26; F21V 29/004; F21V 21/14; F21S 2/005; F21S 8/086; F21S 8/036; F21S 8/085; F16C 11/04; F16C 11/045; F16C 11/10; F16C 11/103

USPC ..... 362/418, 427

See application file for complete search history.

(56) References Cited

U.S. PATENT DOCUMENTS

D155,488 S 5/1949 Crockett
4,228,489 A * 10/1980 Martin ..... 362/249.01

(Continued)

FOREIGN PATENT DOCUMENTS

KR 101044261 * 6/2011 ..... F21S 8/086

OTHER PUBLICATIONS

Espacenet English Translation of KR101044261 and English Abstract of KR101044261.*

*Primary Examiner* — Zheng Song
(74) *Attorney, Agent, or Firm* — Jansson Munger McKinley & Kirby Ltd.

(57) ABSTRACT

A light fixture including a mounting assembly for securing the light fixture to a static structure. The mounting assembly includes a gripper attachable to the static structure and a bar having a gripping region and a first end secured with respect to a main body portion of the light fixture. The mounting assembly may be adjustable such that the light fixture is held in a selected one of a plurality of possible orientations. In such embodiments, the gripper and the bar are configured for a finite number of the orientations such that the light fixture is held in a selected one of a plurality of orientations.

29 Claims, 20 Drawing Sheets

(51) Int. Cl.

| | |
|---|---|
| *F21V 15/01* | (2006.01) |
| *F21W 131/103* | (2006.01) |
| *F21Y 105/10* | (2016.01) |
| *F21Y 115/10* | (2016.01) |

(56) References Cited

U.S. PATENT DOCUMENTS

| | | | | | |
|---|---|---|---|---|---|
| 4,332,363 | A * | 6/1982 | Ware | 248/321 | |
| 4,410,933 | A | 10/1983 | Blake et al. | | |
| 4,426,676 | A * | 1/1984 | Taylor | 362/371 | |
| 4,494,177 | A * | 1/1985 | Matthews | 362/402 | |
| 4,551,793 | A * | 11/1985 | Mellema | 362/370 | |
| 4,931,917 | A * | 6/1990 | Scherf | F21V 21/34 | 362/275 |
| D319,702 | S | 9/1991 | Kane | | |
| 5,357,412 | A * | 10/1994 | Entrop | F21V 3/00 | 362/217.09 |
| D354,558 | S | 1/1995 | Marvin et al. | | |
| D355,722 | S | 2/1995 | Roos et al. | | |
| 5,398,177 | A | 3/1995 | Harwood | | |
| 5,593,225 | A * | 1/1997 | Safyan | F16M 13/02 | 362/218 |
| 5,800,053 | A * | 9/1998 | Shen | 362/413 | |
| 5,833,358 | A | 11/1998 | Patik | | |
| 6,155,701 | A * | 12/2000 | Leen | 362/432 | |
| D505,220 | S | 5/2005 | Stekelenburg | | |
| 7,063,451 | B2 | 6/2006 | Shen | | |
| 7,165,870 | B2 * | 1/2007 | McKenney | 362/369 | |
| D536,816 | S | 2/2007 | Mier-Langner et al. | | |
| D536,817 | S | 2/2007 | Mier-Langner et al. | | |
| D537,972 | S | 3/2007 | Mier-Langner et al. | | |
| D537,973 | S | 3/2007 | Mier-Langner et al. | | |
| D538,459 | S | 3/2007 | Rose et al. | | |
| D538,961 | S | 3/2007 | Mier-Langner et al. | | |
| D539,460 | S | 3/2007 | Mier-Langner et al. | | |
| D539,956 | S | 4/2007 | Rose et al. | | |
| D543,657 | S | 5/2007 | Lehman | | |
| D550,885 | S | 9/2007 | Crosby | | |
| 7,278,761 | B2 * | 10/2007 | Kuan | 362/294 | |
| 7,322,735 | B1 * | 1/2008 | Caldani | 362/648 | |
| D563,013 | S | 2/2008 | Levine | | |
| D563,580 | S | 3/2008 | Prazoff | | |
| D563,582 | S | 3/2008 | Levine | | |
| D564,117 | S | 3/2008 | Lippert | | |
| D571,032 | S | 6/2008 | Chen | | |
| D580,082 | S | 11/2008 | Zemar | | |
| D581,080 | S | 11/2008 | Mier-Langner | | |
| D599,494 | S | 9/2009 | Levine | | |
| D600,400 | S | 9/2009 | Friedman | | |
| 7,665,699 | B2 | 2/2010 | Oddsen, Jr. et al. | | |
| D619,291 | S | 7/2010 | Thevenot | | |
| D626,264 | S | 10/2010 | Liu | | |
| D638,566 | S | 5/2011 | Goelz et al. | | |
| 8,021,026 | B2 * | 9/2011 | Liu et al. | 362/419 | |
| 8,425,071 | B2 * | 4/2013 | Ruud et al. | 362/101 | |
| 8,545,065 | B2 * | 10/2013 | Kim et al. | 362/418 | |
| 2004/0238714 | A1 * | 12/2004 | Slatter | F16B 2/065 | 248/534 |
| 2008/0253138 | A1 * | 10/2008 | Katz | F21V 21/30 | 362/427 |
| 2010/0097815 | A1 * | 4/2010 | Song et al. | 362/418 | |
| 2011/0004157 | A1 | 1/2011 | Dewaele et al. | | |
| 2011/0122634 | A1 * | 5/2011 | Liu | F21V 21/116 | 362/427 |
| 2011/0128737 | A1 * | 6/2011 | Kim | F21V 21/30 | 362/249.03 |
| 2012/0287643 | A1 * | 11/2012 | Wang | F21S 8/086 | 362/294 |
| 2013/0088861 | A1 * | 4/2013 | Wu | F21V 21/116 | 362/184 |
| 2013/0141902 | A1 * | 6/2013 | Akdag | F21S 8/086 | 362/191 |
| 2014/0340907 | A1 * | 11/2014 | Yu | F21V 15/01 | 362/294 |

* cited by examiner

60

60

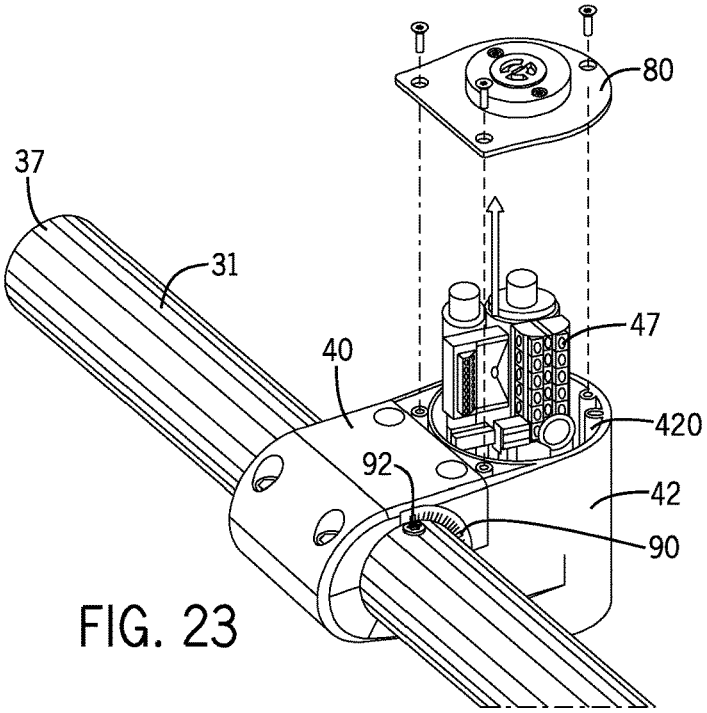
FIG. 23
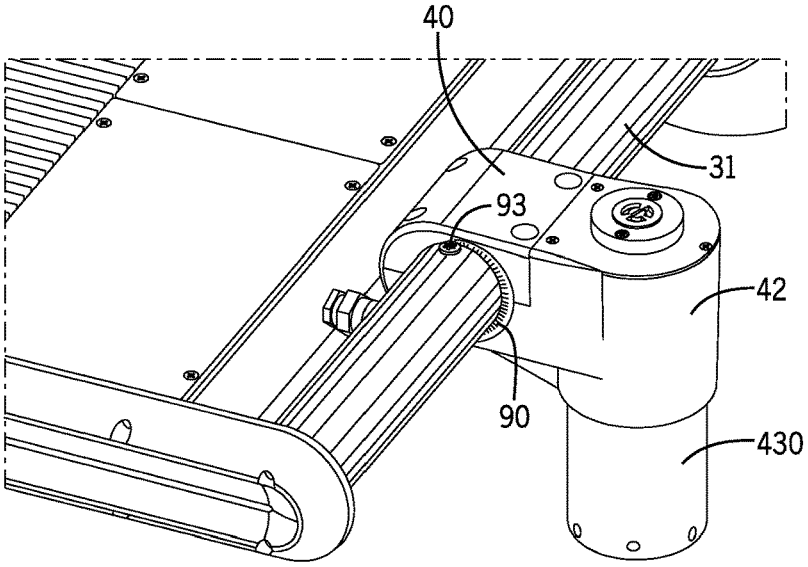
FIG. 24
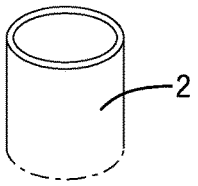

LIGHT FIXTURE

RELATED APPLICATION

This application claims the benefit of U.S. Provisional Application Ser. No. 61/624,211, filed Apr. 13, 2012. The entirety of the contents of Application Ser. No. 61/624,211 is incorporated herein by reference.

FIELD OF THE INVENTION

This invention relates to lighting fixtures and, more particularly, to mounting assemblies for securing light fixtures with respect to static structures.

BACKGROUND OF THE INVENTION

Light fixtures such as floodlights are often used for illumination of a selected area or object and typically need to be adjusted into a desired orientation for maximal effect. Adjustable light fixtures are popular with architects, lighting designers and building owners as a way to visually "highlight" certain building and landscape features and improve the nighttime appearance of buildings and grounds.

Large properties may require, e.g., a dozen or even several dozen well-placed floodlights for the intended illumination purpose. Architects and lighting designers are justifiably concerned that each floodlight be capable of being precisely directed toward the particular feature to be illuminated. This means that the floodlight should have a mounting arrangement that permits a wide range of aiming angles.

In recent years, light fixtures increasingly use LEDs as light sources, and these present particularly challenging problems in fixture development. A new LED light fixture which responds to the needs of architects, lighting designers and contractors and which provides certain manufacturing economies would be an important advance in the art.

There is a need in the lighting industry for improved light fixtures using LED light sources—fixtures that are adaptable for a wide variety of mounting angles and situations, and that satisfy the other issues associated with high-illumination LED light fixtures.

SUMMARY OF THE INVENTION

The present invention relates to improved mounting assembly for securing a light fixture to a static structure.

In one aspect of this invention, the inventive mounting assembly includes a bar having a gripping region and a gripper grips the gripping region such that the light fixture is held with respect to the static structure. The bar has a first end secured with respect to one of the static structure and a main body portion of the light fixture. The gripper is attachable to the other of the static structure and the main body portion of the light fixture.

In some embodiments, the inventive mounting assembly facilitates adjustment of the light fixture to a selected one plurality of possible orientations during installation. In some of such embodiments, the gripper grips the gripping region such that the light fixture is held in a selected one of the plurality of possible orientations.

In certain embodiments the mounting assembly is not adjustable. The bar may have a cross-sectional shape which is gripped by the gripper such that the fixture is held in only one orientation. Such cross-sectional shape of the bar may include rectangular shapes such as square.

In some embodiments, the first end of the bar is secured with respect to the main body portion of the light fixture. In such embodiments, the gripper is attachable to the static structure.

In certain embodiments of the adjustable mounting assembly, the gripper and the bar may be configured for a finite number of the orientations. The mounting assembly of some of such embodiments further includes a guide indicating the angle for each of the orientations of the light fixture with respect to the static structure.

The guide may be a bracket removably secured with respect to the bar at a plurality of positions therealong. In some embodiments, the bracket is shaped to follow the outer shape of the bar and includes angle markings, and the gripper has a reference line which points to a particular one of the angle markings indicating the angle of the light fixture with respect to the static structure.

The bar also has a second end opposite the first end. In some embodiments, the second end may also be secured with respect to the main body portion; in such embodiments, the gripping region is between the first and second ends and is spaced from the main body portion. In some of such embodiments, the gripper-bar orientations include a number of positions of the gripper along the bar.

In some embodiments, the bar defines a plurality of positions for securing the bracket therealong.

The mounting assembly of the present invention may further include at least one bar support that projects from the main body portion. In such embodiments, the first end of the bar is supported by the bar support such that the gripping region is along and spaced from the main body portion. The bar support may include a bar-support portion engaged with the first end of the bar. In some embodiments, the bar is hollow. In such embodiments, the bar-support portion is inserted into the first end of the bar. The bar interior and the bar-support portion are preferably shaped to prevent relative rotation.

In certain embodiments, the gripper includes first and second bar-engaging portions facing one another with the bar therebetween. The bar is preferably substantially cylindrical. In such embodiments, each of the bar-engaging portions has a semi-cylindrical bar-engaging surface. The semi-cylindrical bar-engaging portions together encircle and engage the bar.

The gripper and the bar are configured for a finite number of orientations. The gripping region and the gripper preferably have anti-rotational interlocking features complementary to one another such that, when the anti-rotational interlocking features of the bar-engaging portions are interlocked with the interlocking features of the bar, the light fixture is held in a selected one of a finite plurality of orientations. The anti-rotational interlocking features may include parallel inter-engaged flutes and grooves along the gripping region of the bar and the gripper. The bar may be made by extrusion, e.g., of a suitable metal such as aluminum or tough, rigid, structural polymeric material.

The first bar-engaging portion may be configured for securement with respect to the static structure and the second bar-engagement portion be configured for attachment to the first bar-engagement portion with the bar sandwiched therebetween. In some versions, the first bar-engaging portion is configured for attachment atop a light pole.

Another aspect of the present invention is a light fixture including the main body portion and the mounting assembly for adjustable securement to a static structure such that, when the anti-rotational interlocking features of the bar-engaging portions are interlocked with the interlocking features of the bar, the light fixture is held in a selected one of a finite plurality of orientations.

BRIEF DESCRIPTION OF THE DRAWINGS

FIG. 23 is a perspective view of the mounting assembly of the light fixture of FIG. 21 with removed cover assembly and showing a terminal block being inserted into a pole-connector enclosure.

FIG. 24 is a fragmentary perspective view of the LED light fixture as in FIG. 21 in a position for installation atop a round tenon.

DETAILED DESCRIPTION OF PREFERRED EMBODIMENTS

Figure 1:
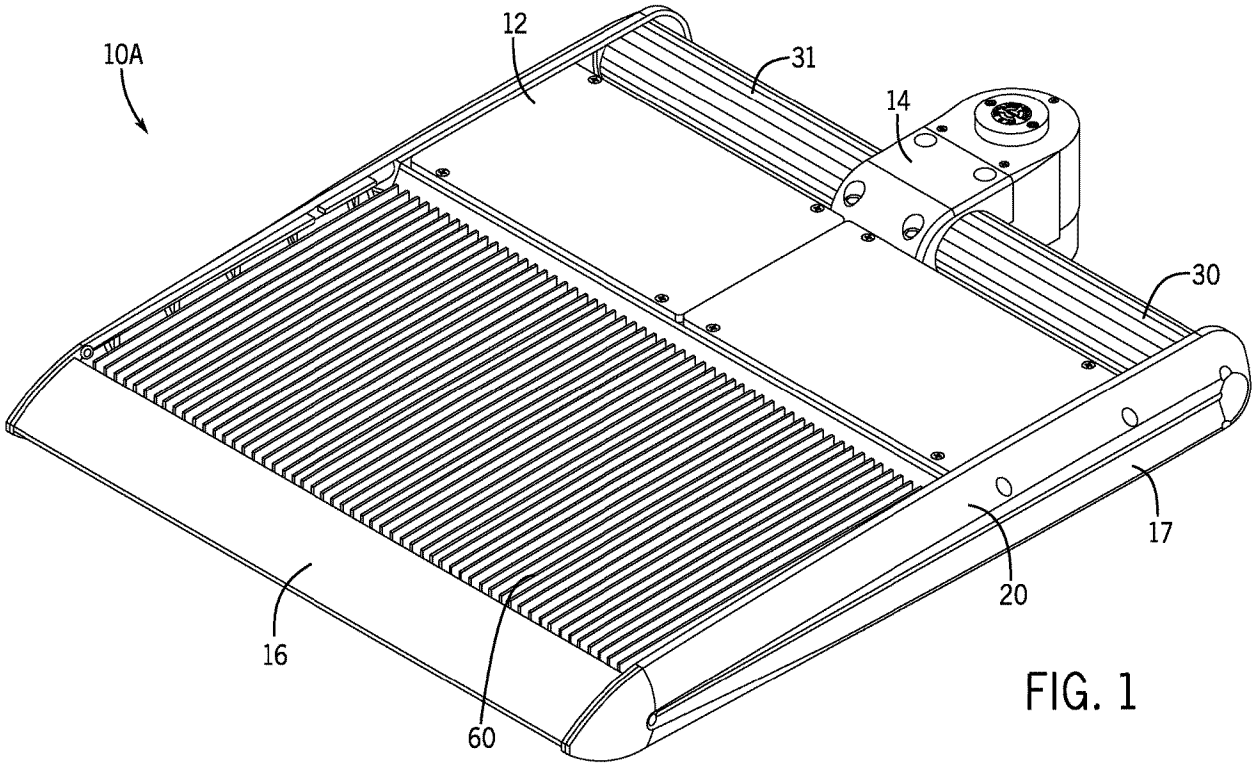
FIG. 1 is a top perspective view of one embodiment of an LED light fixture in accordance with this invention.

FIGS. 1-11 illustrate LED light fixtures 10A and 10B (the latter in FIG. 2 only) in accordance with this invention. Common or similar parts are given the same numbers in the drawings of both embodiments, and the light fixtures are often referred to by the numeral 10, without the A or B lettering used in the drawings, and in the singular for convenience.

Figure 2:
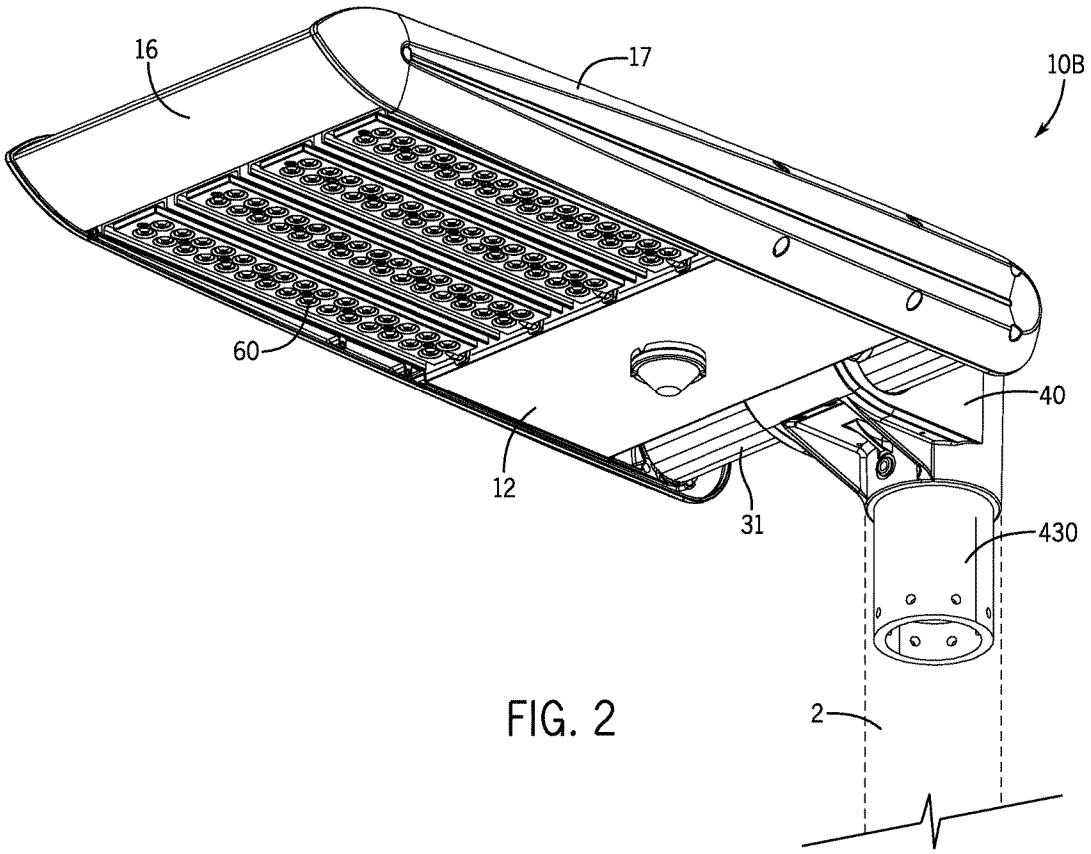
FIG. 2 is a bottom perspective view of another embodiment of an LED light fixture in accordance with this invention, and including fewer LED modules than the embodiment of FIG. 1.

Light fixture 10 includes a main body portion 20 and a mounting assembly 30 for adjustable securement to a static structure. An exemplary static structure is shown in FIG. 2 as a pole 12 atop which fixture 10 may be installed. It should be understood, of course, that the inventive light fixture 10 may be mounted with respect to other static structures such as walls, ceilings, along-ground mounts, free-standing advertising frames and the like.

Figure 3:
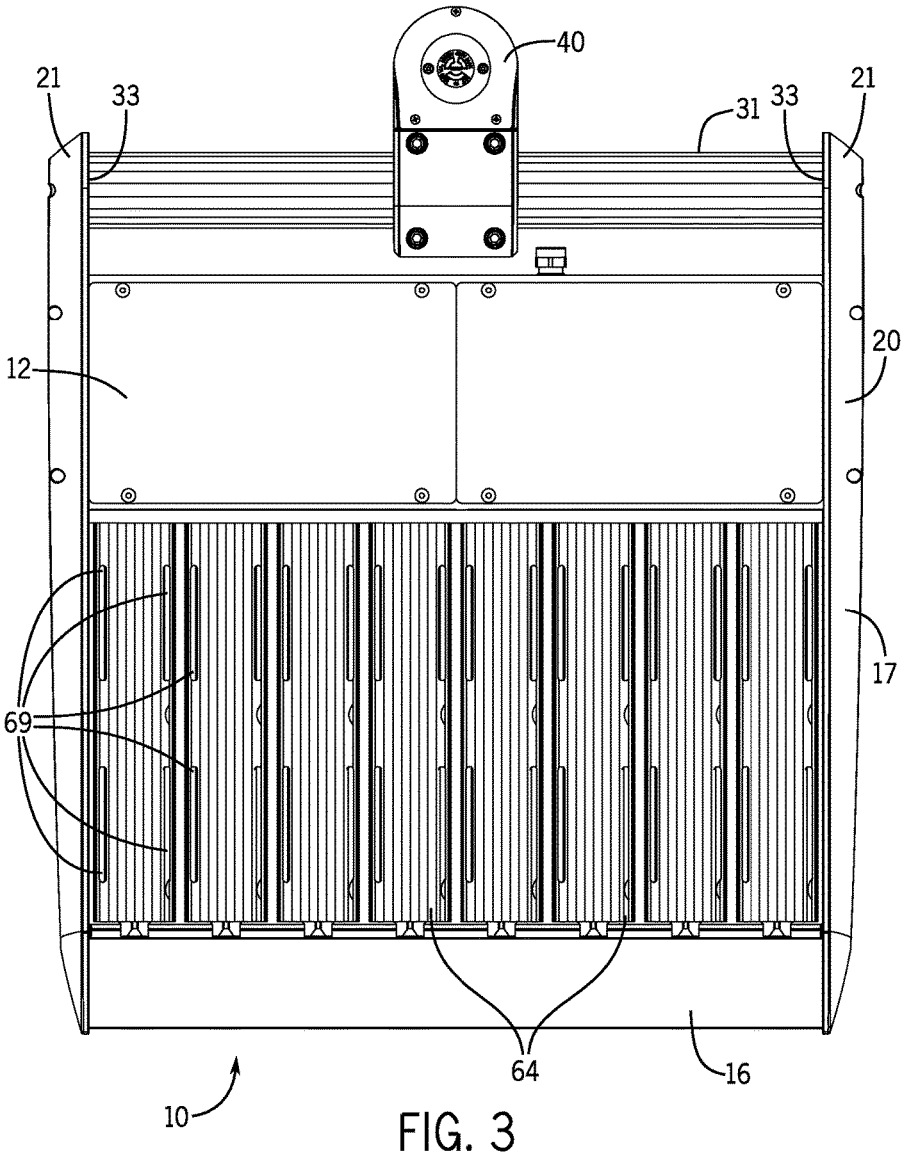
FIG. 3 is a top plan view of the LED light fixture of FIG. 1.
Figure 4:
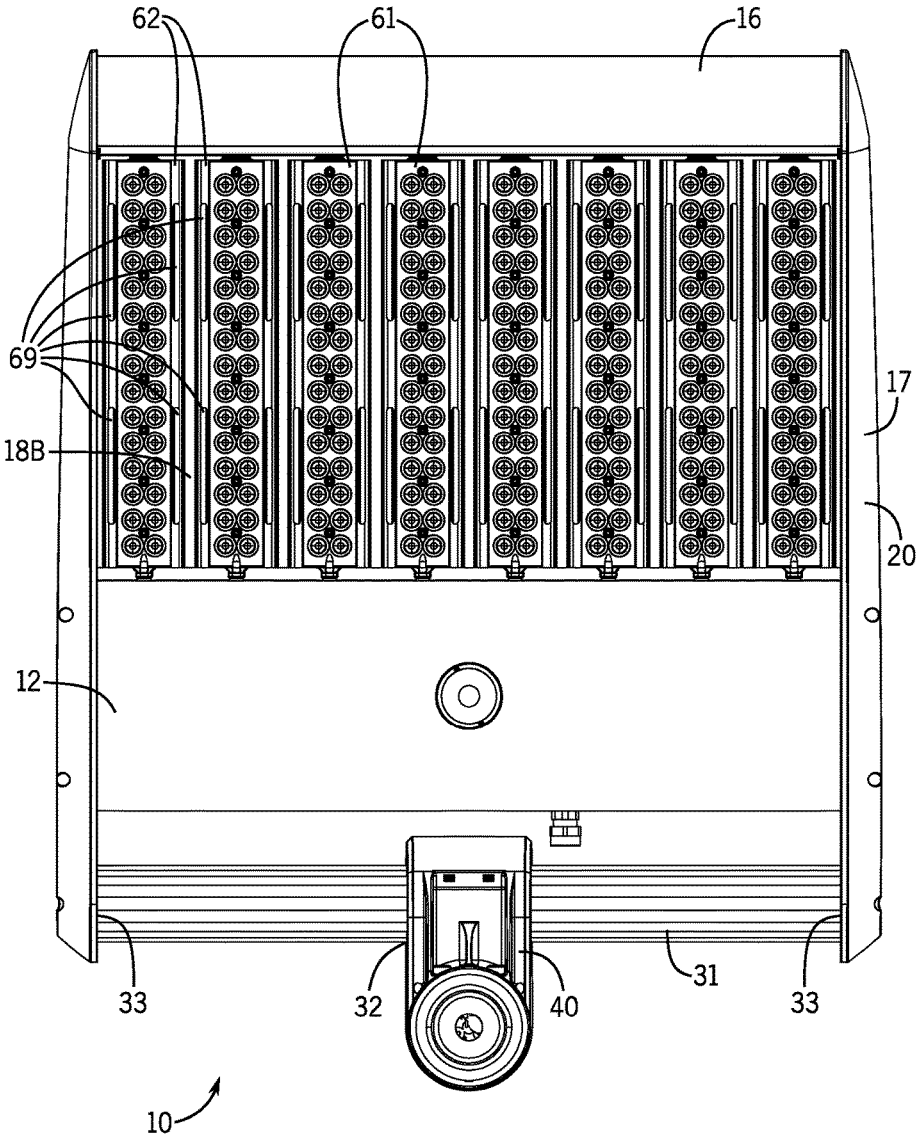
FIG. 4 is a bottom plan view of the LED light fixture of FIG. 1.
Figure 6A:
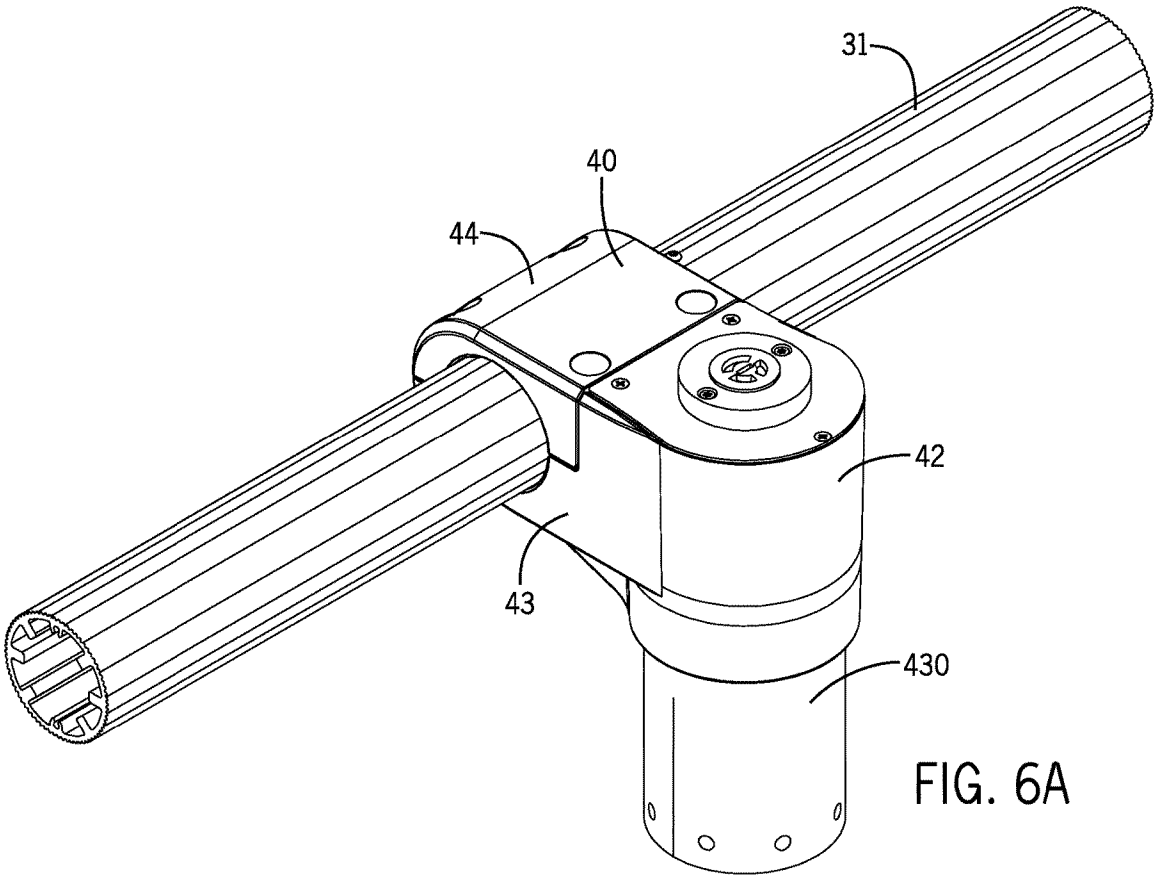
FIG. 6A is a top perspective view of a mounting assembly in accordance with the present invention.
Figure 6B:
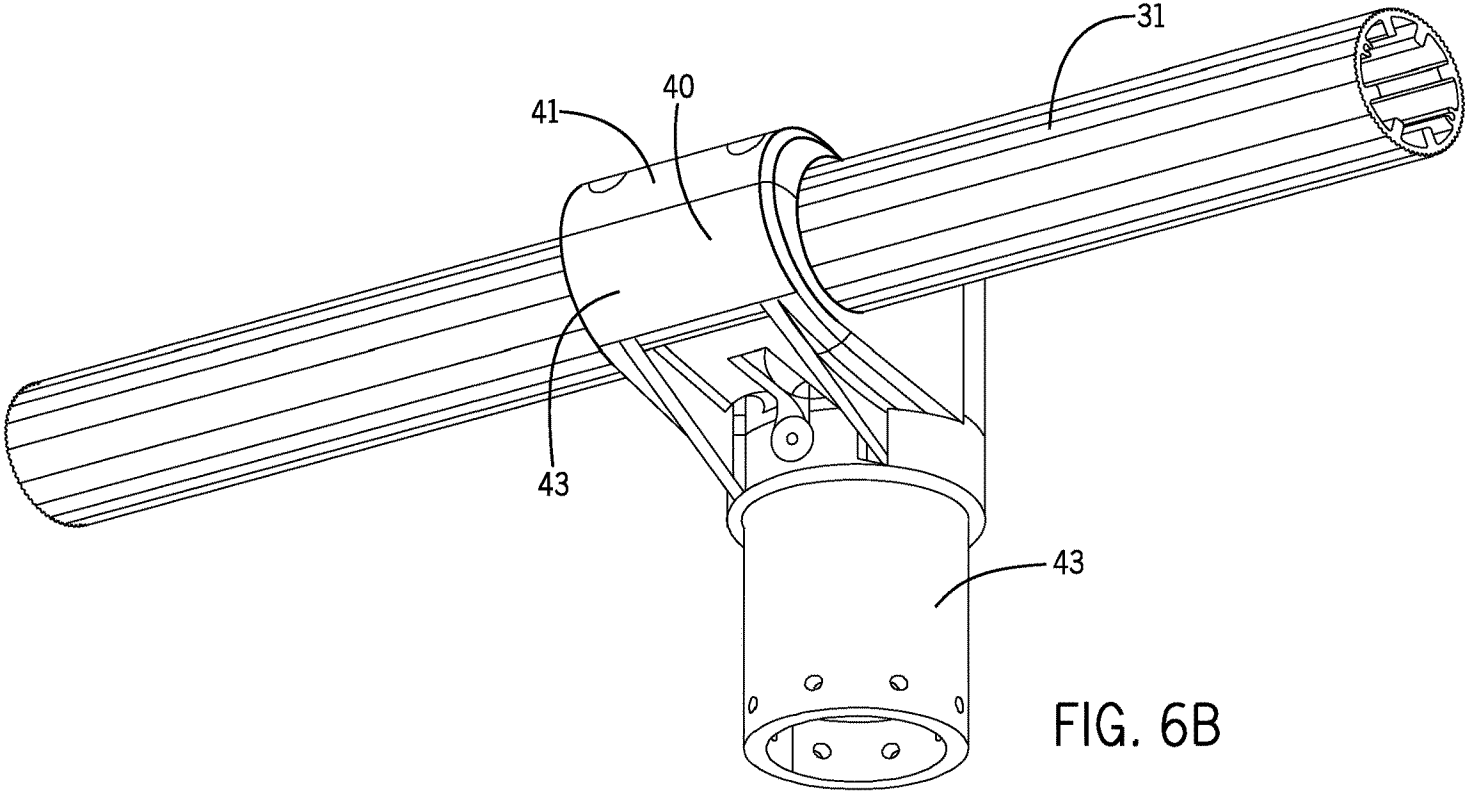
FIG. 6B is a bottom perspective view of the mounting assembly of FIG. 6A.
Figure 7:
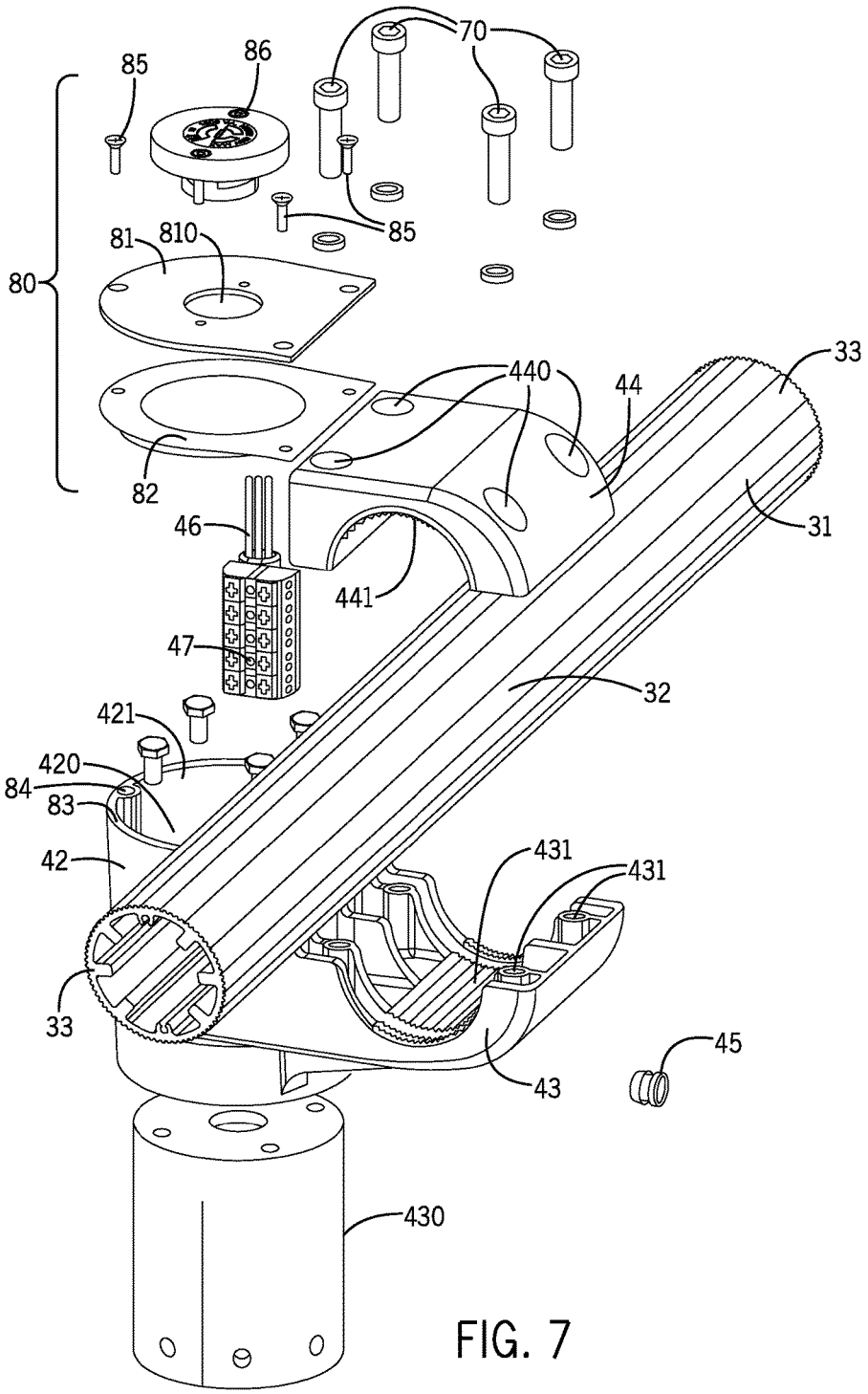
FIG. 7 is an exploded perspective view of the mounting assembly of FIG. 6A.

Mounting assembly 30 illustrated in FIGS. 1-10 includes a bar 31 having a gripping region 32 and a gripper 40 attachable to pole 12. As best seen in FIGS. 6-7, gripper 40 grips gripping region 32 such that light fixture 10 is held in a selected one of a plurality of orientations. In the illustrated embodiment, bar 31 has first and second opposite ends 33 secured with respect to main body portion 20 of light fixture 10. FIGS. 3 and 4 best show gripping region 32 being between first and second ends 33 and spaced from main body portion 20.

Figure 10:
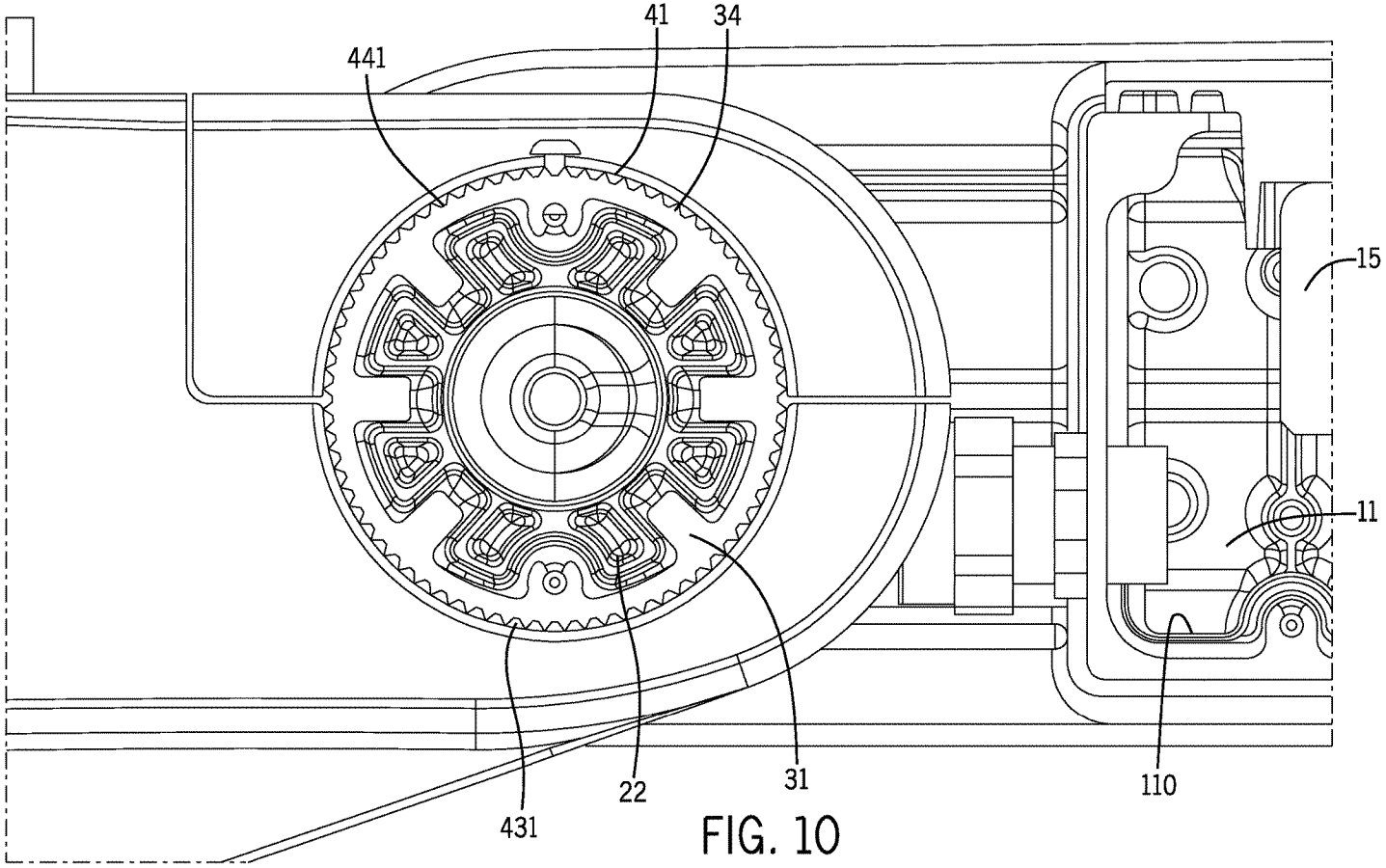
FIG. 10 is a fragmentary sectional view showing the bar-support portion inside the bar interior and illustrating their engagement preventing relative rotation.

In FIGS. 1-5, a pair of bar supports 21 are shown projecting from main body portion 20. FIGS. 3 and 4 best illustrate that first and ends 33 of bar 31 are each supported by one of the bar supports 21 such that gripping region 32 is along and spaced from main body portion 20. FIGS. 5 and 8-10 show each bar support 21 including a bar-support portion 22 engaged with end 33 of bar 31. In FIGS. 5-8, bar 31 is shown hollow. FIG. 10 best illustrates bar-support portion 22 inserted into end 33 of bar 31. As further seen in FIGS. 8-10, bar interior 36 and bar-support portion 22 are each shaped to prevent relative rotation.

Figure 8:
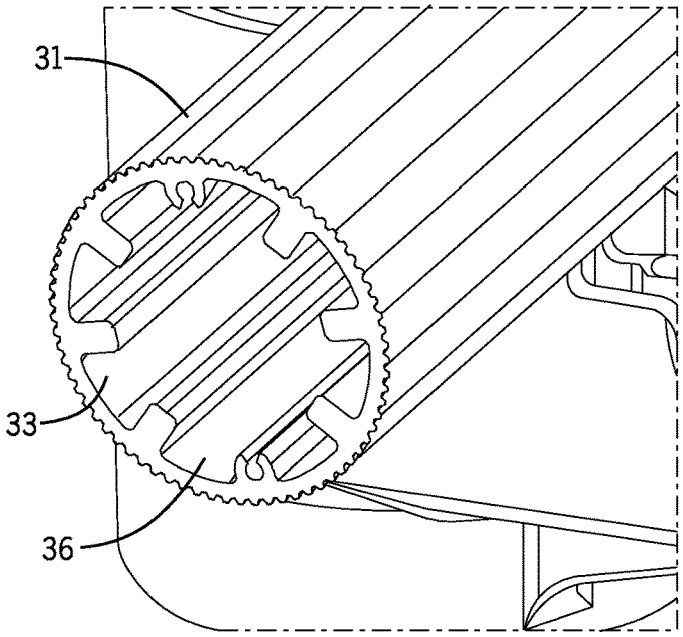
FIG. 8 is a fragmentary view of a bar and illustrating the bar interior.
Figure 9:
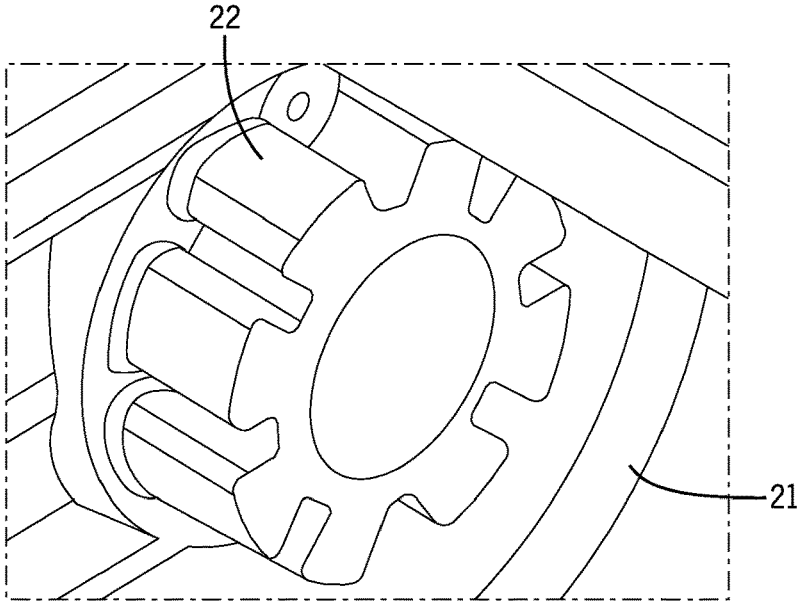
FIG. 9 is a fragmentary view of a bar-support portion shaped for insertion into the bar interior.

In FIGS. 6-8, bar 31 is shown as substantially cylindrical extruded piece.

FIGS. 6A and 6B best illustrate gripper 40 including a first bar-engaging portion 43 and a second bar-engaging portion 44 facing one another with bar 31 sandwiched therebetween. FIG. 7 best shows that each of bar-engaging portions 43 and 44 has a semi-cylindrical bar-engaging surface 431 and 441, respectively. Semi-cylindrical bar-engaging portions 43 and 44 together encircle and engage bar 31.

Bar-engaging surfaces 431 and 441 of gripper 40 and gripping region 32 of bar 31 are configured for a finite number of the orientations. As seen in FIGS. 7 and 10, gripping region 32 of bar 31 has parallel inter-engaged flutes and grooves 34 which are complementary to flutes and grooves 41 along bar-engaging surfaces 431 and 441 of gripper 40. These complementary flutes and grooves 34 and 41 also serve as anti-rotational interlocking features between bar 31 and gripper 40 which when interlocked hold light fixture 10 in a selected one of the finite plurality of orientations.

Figure 22:
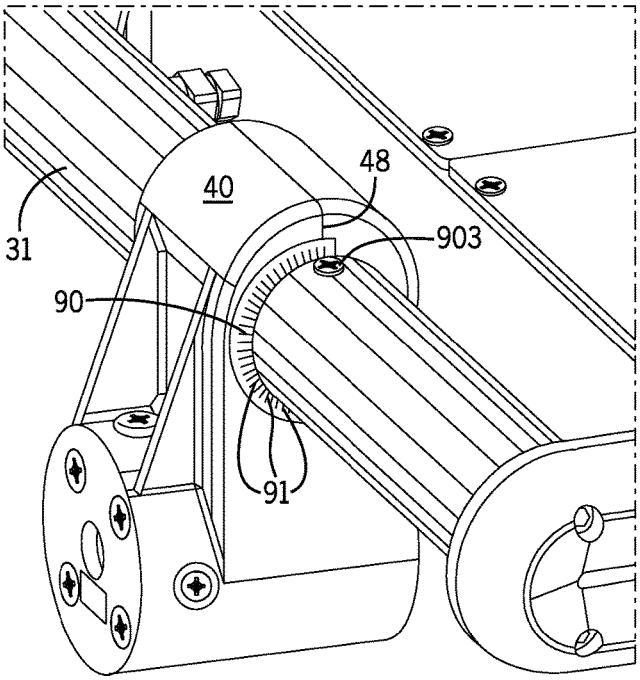
FIG. 22 is an enlarged portion of FIG. 21 showing details of the bracket.
Figure 25:
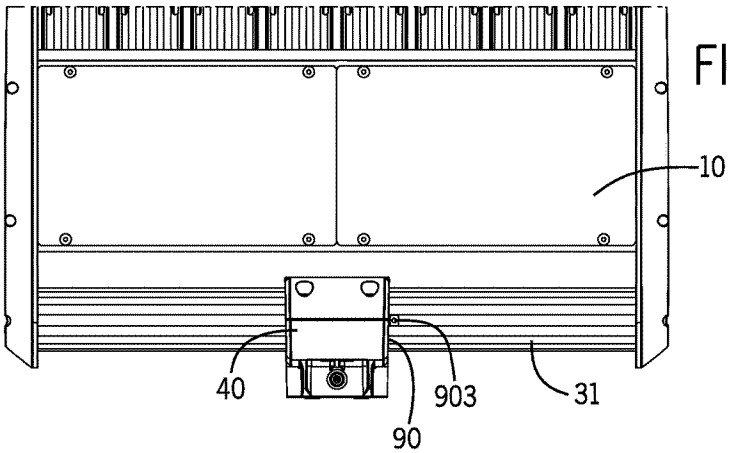
FIG. 25 is a fragmentary top plan view of the LED light fixture of FIG. 21.
Figure 26:
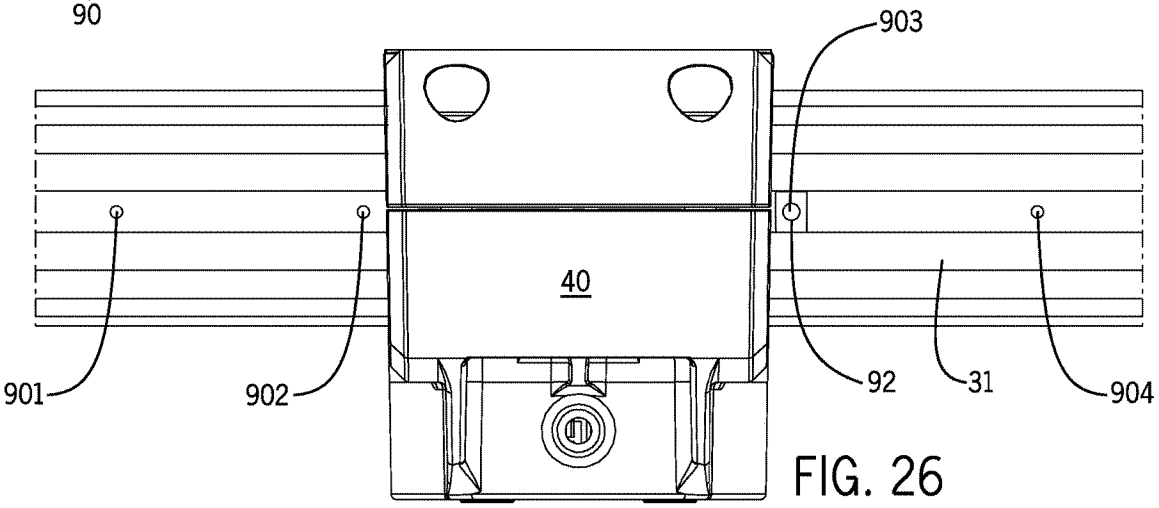
FIG. 26 is an enlarged portion of FIG. 25 showing details of the bar.

FIGS. 21-26 illustrate mounting assembly 30 including a guide which indicates the angle for each of the orientations of light fixture 10 with respect to the static structure. These figures show the guide in the form of a bracket 90 which is removably secured with respect to bar 31. FIGS. 25 and 26 show positions 901, 902, 903 and 904 along the bar at which bracket 90 may be secured. FIG. 26 shows these positions in the form of apertures defined by bar 31. It is also seen in FIGS. 25 and 26 that bracket 90 includes a flange 92 for each of the apertures. Flange 92 defines a hole aligned with the corresponding aperture and receives a fastener therethrough for securing bracket 90 to bar 31. In FIGS. 25 and 26, bracket 90 is secured at position 903. In FIGS. 23 and 24, bracket 90 is secured at position 902. As seen in FIGS. 21-24, bracket 90 is shaped to follow outer shape 37 of bar 31 and includes angle markings 91. It is best seen in FIG. 22 that gripper 40 has a reference line 48 which points to a particular one of angle markings 91 indicating the angle of light fixture 10 with respect to the static structure such as round tenon 2 or square pole 2A.

FIGS. 2 and 7 show first bar-engaging portion 43 including a pole-engaging portion 430 configured for securement with respect to pole 12. Second bar-engagement portion 44 is shown configured for attachment to first bar-engagement portion 43 with bar 31 sandwiched therebetween. FIG. 7 shows that first bar-engaging portion 43 defines mounting cavities 432 accepting fasteners 70 which extend through apertures 440 formed through second bar-engagement portion 44.

Figure 5:
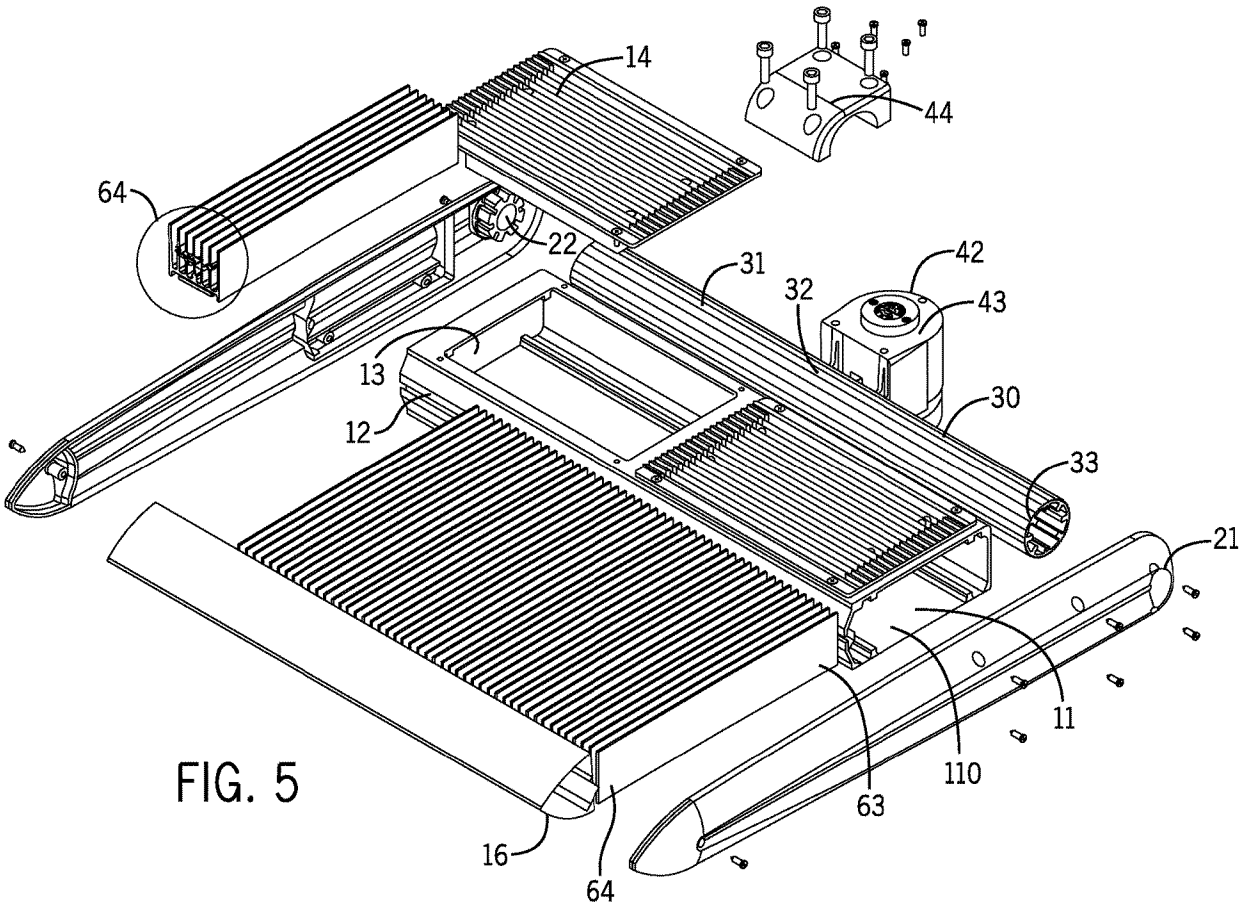
FIG. 5 is an exploded top perspective view of the LED light fixture of FIG. 1.

FIGS. 1-5, 11 and 14 show light fixture 10 further including a closed chamber 11 defined by a driver housing 12 shown in FIG. 5 as an extruded piece. It is further best seen in FIG. 5 that chamber 11 has an access opening 13 and a driver door 14 for placement of an LED driver 15 into chamber 11. In FIGS. 10 and 15, an electronic LED driver 15 is seen enclosed within chamber 11.

Figure 19:
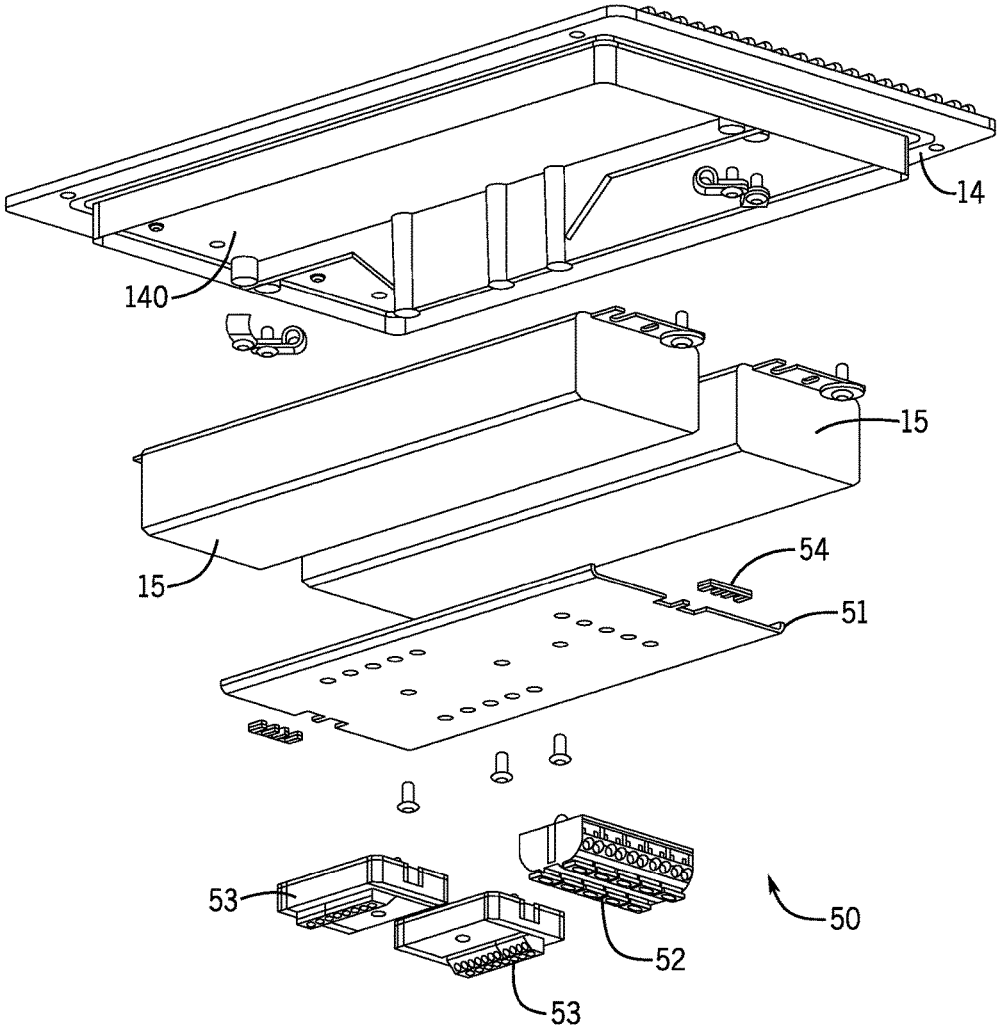
FIG. 19 is a perspective view of an LED driver module of light fixtures of FIG. 1
Figure 20:
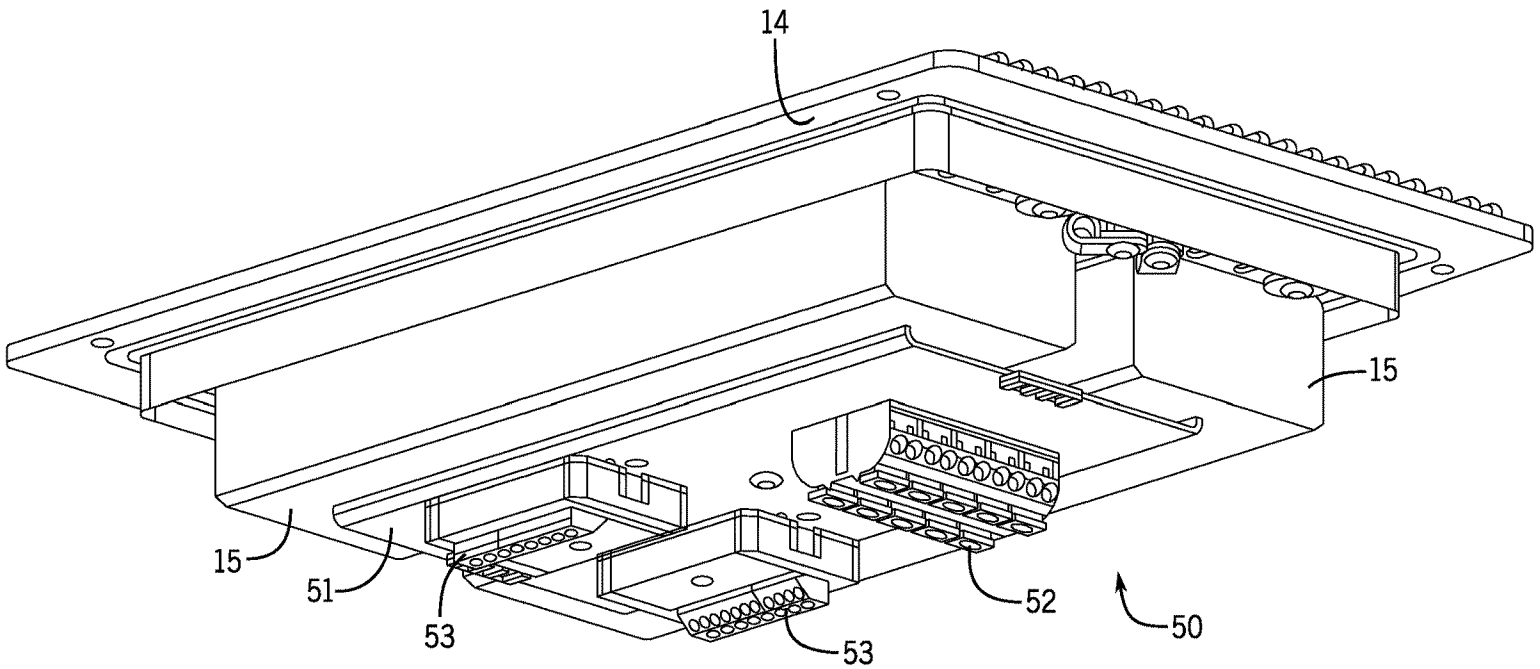
FIG. 20 is an exploded perspective view of the LED driver module of FIG. 19.
Figure 21:
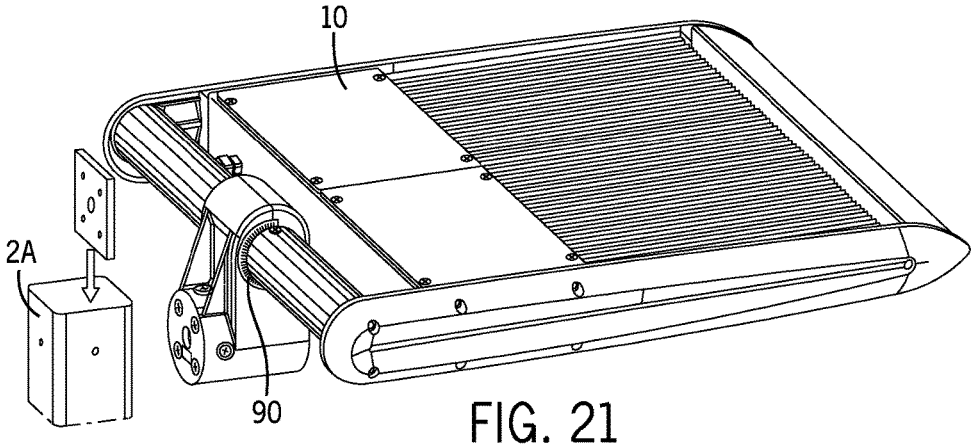
FIG. 21 is a perspective view of the LED light fixture in a position for installation to a square pole, the mounting assembly including a bracket indicating an angle of the light fixture with respect to the pole.

FIGS. 19 and 20 illustrate a driver module 50 including two LED drivers 15 attached to driver door 14 and secured with a mounting plate 51 which supports a terminal block 52, secondary-surge elements 53 and wire guards 54. Driver door 14 is shown as a cast piece configured to support LED driver module 50 thereagainst. As seen in FIG. 5, driver module 50 is positioned such that driver-supporting surface 140 of driver door 14 is oriented substantially down such that driver 15 is spaced above bottom 110 of chamber 11 and is away from any water that might access chamber 11 and accumulate along its bottom 110.

FIG. 5 also shows mounting arrangement 30 positioned adjacent driver housing 11 with bar 31 extending along driver housing 11 and spaced therefrom (also shown in FIGS. 3 and 4).

FIG. 7 shows that first bar-engaging portion 43 further includes a pole-connecting section 42 enclosing wiring 46 and electrical elements such as a terminal block 47 and having a weather-proof wire access 45 thereto for electrical connection of light fixture 10. As seen in FIGS. 6-7, pole-connecting section 42 forms an enclosure 420 accessible through an opening 421 with a cover assembly 80 including a cover plate 81 and a gasket 82. Edge 83 defines fastener receiving cavities 84 accepting fasteners 85 which press cover plate 81 against an edge 83 of opening 421 with gasket 82 sandwiched therebetween. Cover plate 81 defines an aperture 810 which is closeable with a lock-closure 86.

FIGS. 1-4 further show that light fixture 10 includes an LED assembly 60 which is open to air/water flow thereover. As seen in FIGS. 2 and 4, LED assembly 60 has a plurality of LED-array modules 61 each secured to an individual LED heat sink 62 (best seen in FIG. 3) which has first and second heat-sink ends 63 and 64 best seen in FIG. 5. It is further seen in FIGS. 1-4 that LED assembly 60 is bordered by driver housing 12 and a nose structure 16 each along one of opposite heat-sink ends 63 and 64, and that driver housing 12 and nose structure 16 are secured with respect to one another by a frame portion 17 extending alongside LED assembly 60.

Figure 11:
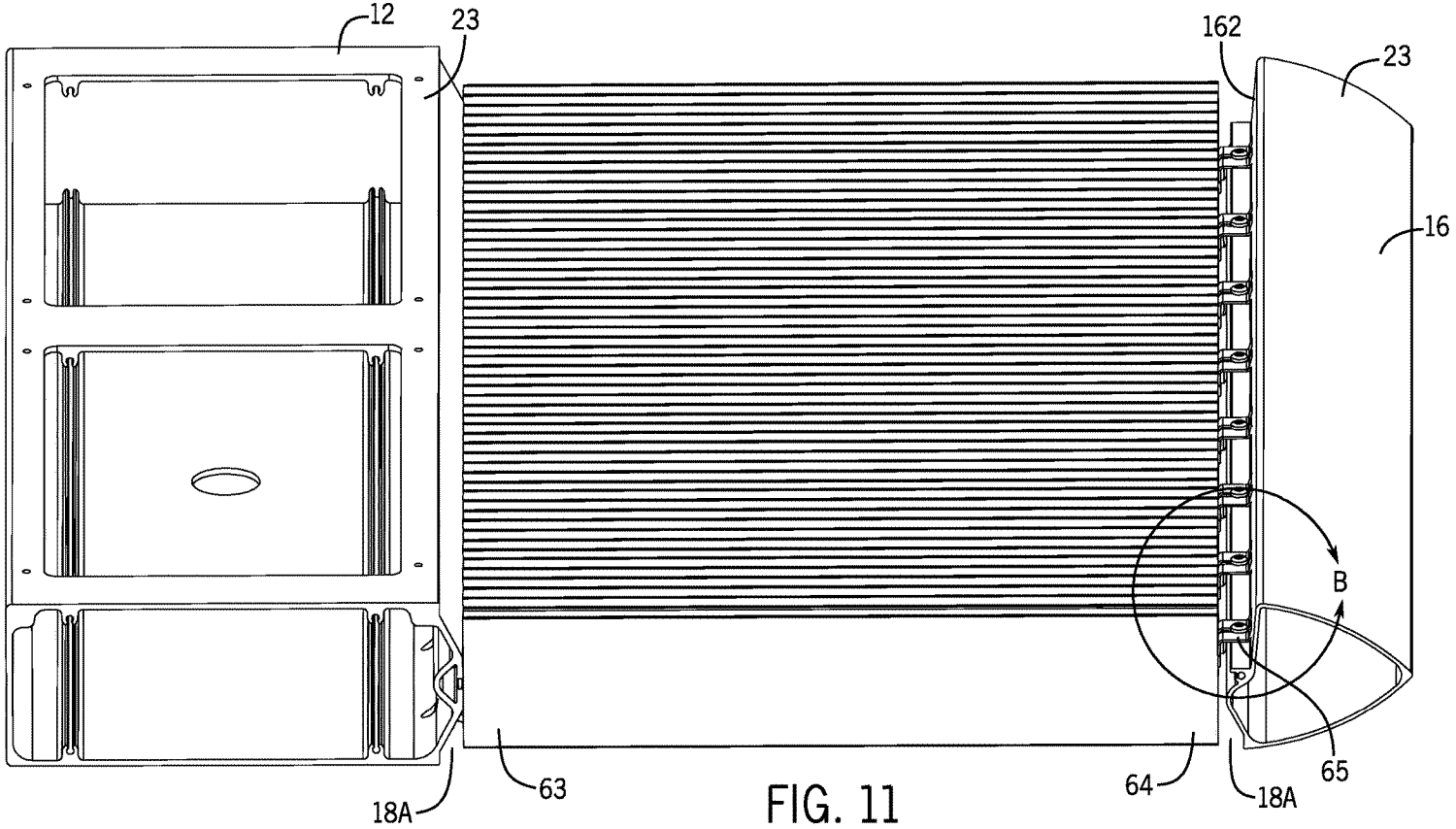
FIG. 11 is a fragmentary sectional perspective view illustrating mounting of LED heat sinks of the LED assembly of the light fixture of FIG. 1.
Figure 12:
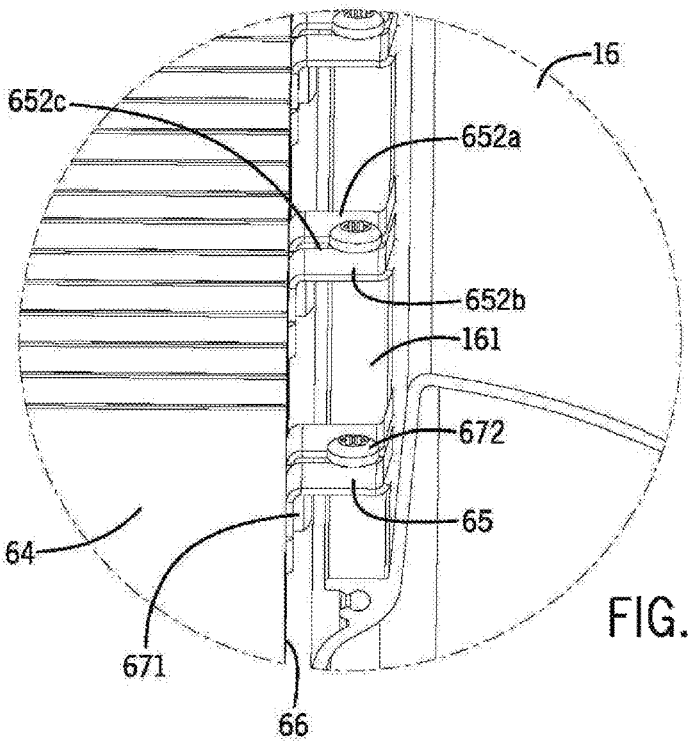
FIG. 12 is a fragmentary perspective view of the mounting engagement of one end of the LED heat sinks, as shown in FIG. 11.
Figure 13:
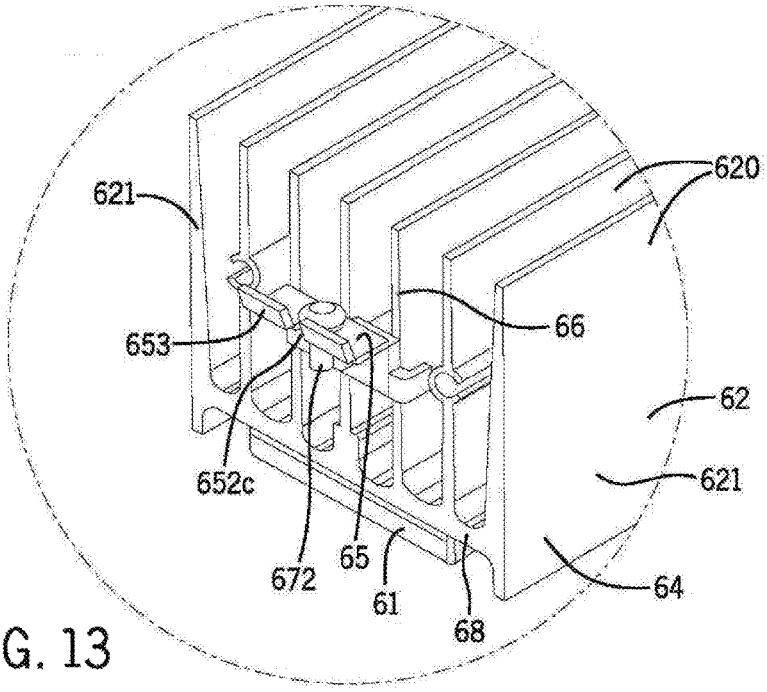
FIG. 13 is a fragmentary perspective view of one LED heat sink illustrating a mounting clip shown in FIG. 12 and seen in FIG. 5.
Figure 14:
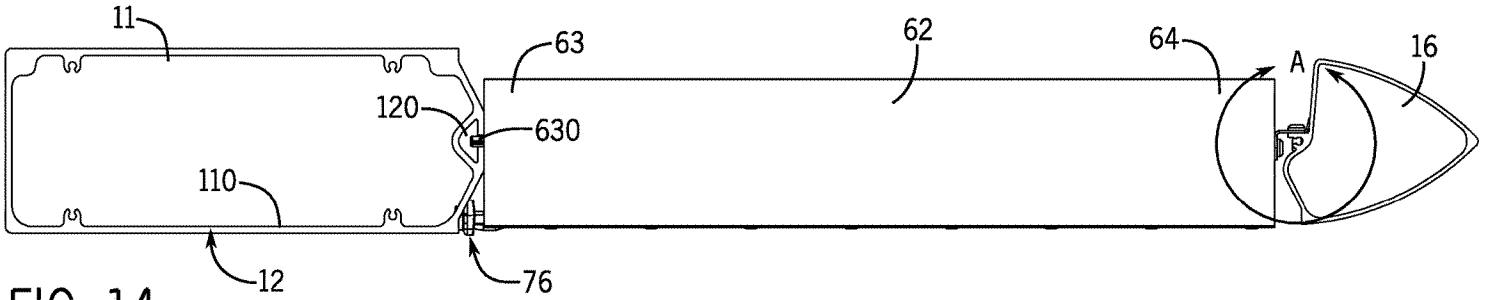
FIG. 14 is a sectional side view of the mounting of LED heat sinks, as shown in FIG. 11.
Figure 16:
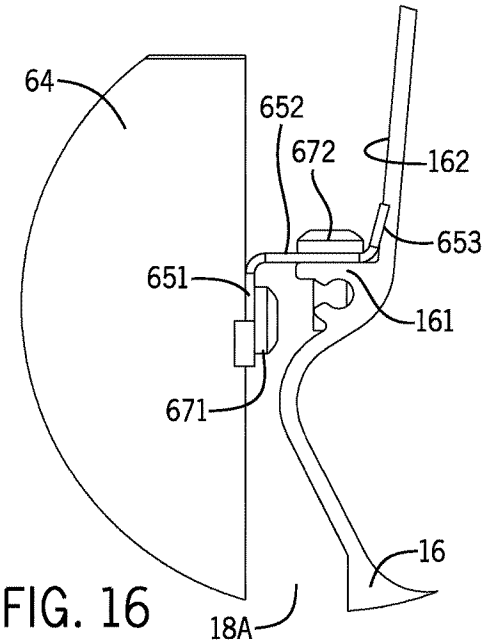
FIG. 16 is a fragmentary sectional side view of the mounting clip holding the end of the LED heat sink, as shown in FIG. 14.
Figure 15:
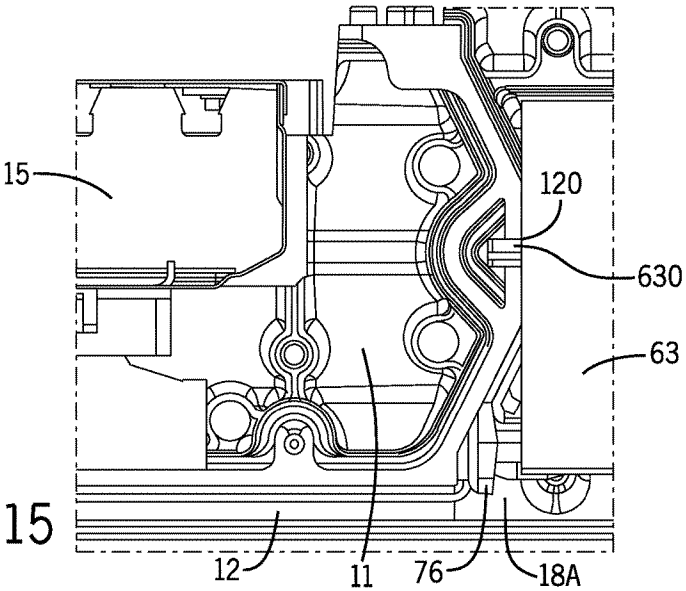
FIG. 15 is a fragmentary sectional side view of the mounting engagement of the other end of the LED heat sinks, as shown in FIGS. 11 and 14.

FIGS. 11-16 illustrate an engagement of first heat-sink end 63 with driver housing 12 and a securement of second heat-sink end 64 to nose structure 16. It is best seen in FIGS. 14 and 15 that first heat-sink end 63 includes a pin 630 extending therefrom and inserted into a slot 120 formed along driver housing 12. FIGS. 11-14 and 16 show second heat-sink end 64 secured with respect to nose structure 16 with a spring clip 65. FIGS. 12, 13 and 16 show clip 65 formed from a sheet metal bent into first, second and third clip portions 651, 652 and 653. First clip portion 651 is attached to a substantially vertical fin edge 66 of second heat-sink end 64 with a fastener 671. Second clip portion 652 is substantially orthogonal to first clip portion 651 and has two subportions 652*a* and 652*b* with an opening 652*c* therebetween. Second clip portion 652 is attached to a substantially horizontal shelf 161 formed along nose structure 16 with a fastener 672 extending through opening 652*c* and pressing second clip subportions 652*a* and 652*b* against self 161. Third clip portion 653 extends from second clip portion 652 toward a surface 162 of nose structure 16 and extending transversely to shelf 161. Third clip portion 653 presses against surface 162 and by its spring action pushes pin 630 of first heat-sink end 63 into slot 102 for secure holding of heat sink 62 within fixture 10 and provides a positive seal on a light-module grommet 760. FIGS. 11 and 12 further show that each of the plurality of heat sinks 62 is individually secured with respect to driver housing 12 and nose structure 16 in the above-described manner.

Figure 17:
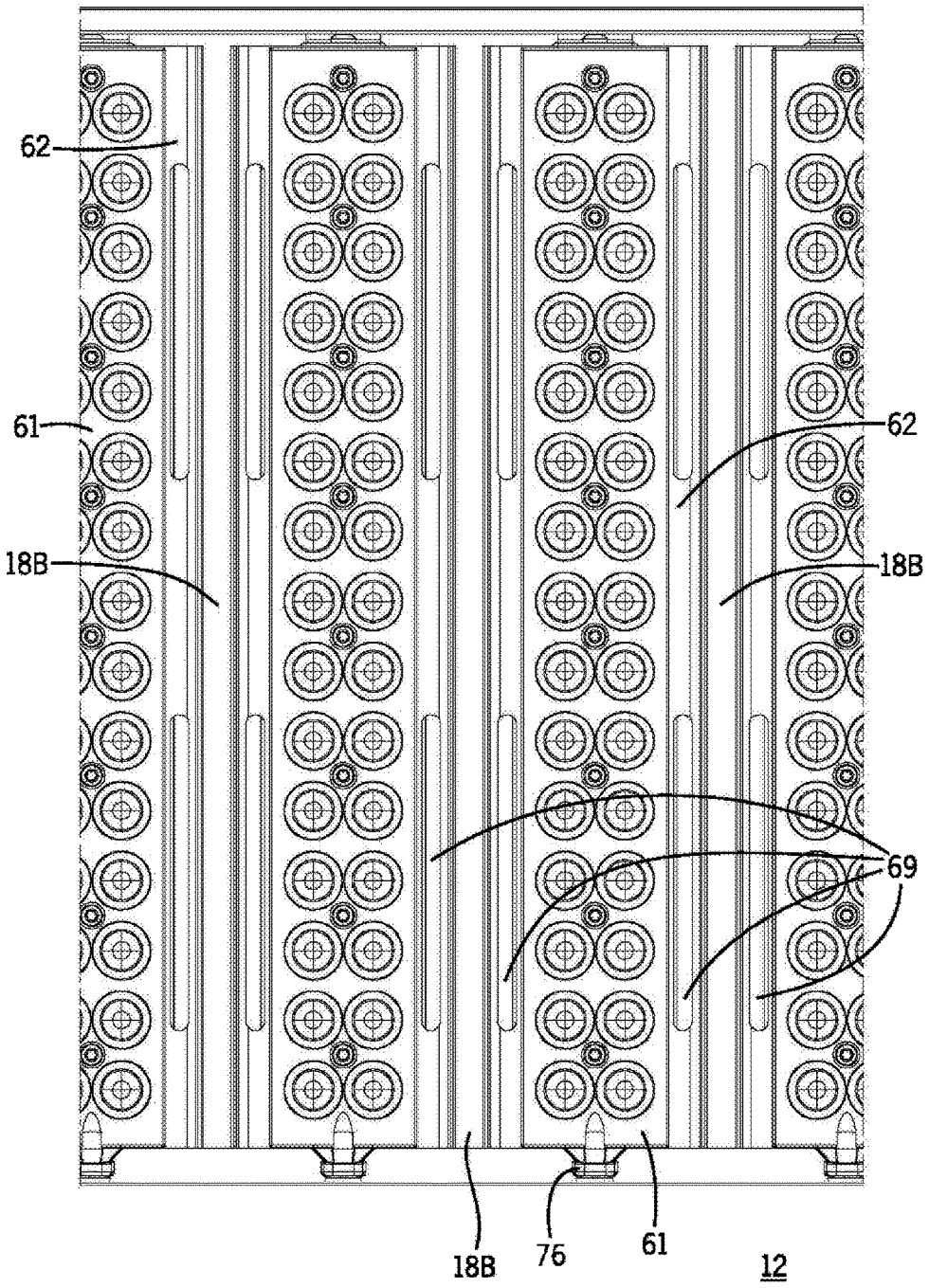
FIG. 17 is a fragmentary bottom plan view of the LED assembly shown in FIG. 4 and illustrating in more detail air-flow channels facilitating heat dissipation from LEDs.

FIGS. 11 and 14 further show fixture 10 having air gaps 18A along first and second heat sink ends 63 and 64 permitting air/water-flow to and from heat sinks 62 through heat sink ends 63 and 64. FIGS. 3, 4 and 17 show fixture 10 further having air gaps 18B defined between adjacent pairs of heat sinks 62 to provide heat removal along entire length of each heat sink 62 by cool air drawn from below LED assembly 60 through air gaps 18B by rising heated air. It is seen in FIG. 13 that side fins 621 are thicker than middle fins 622 to conduct heat through a heat-sink base 68 away from LED-array module 61 for heat removal facilitated with air-flow through air gaps 18B along side fins 621.

It is further seen in FIG. 17 that each heat sink 62 has venting apertures 69 formed therethrough to provide cool-air ingress to and along heat-dissipating fins 620 by upward flow of heated air therefrom. FIGS. 3, 4 and 17 show venting apertures 69 formed along sides of heat sinks 62 with LED-array module 61 positioned between venting apertures 69. FIG. 13 shows that heat-sink base 68 has thickness which is the thinnest along the middle of heat sink 62 and is the greatest along sides of LED module 61, thus conducting heat away from LED module 61 toward venting apertures 69.

Figure 18:
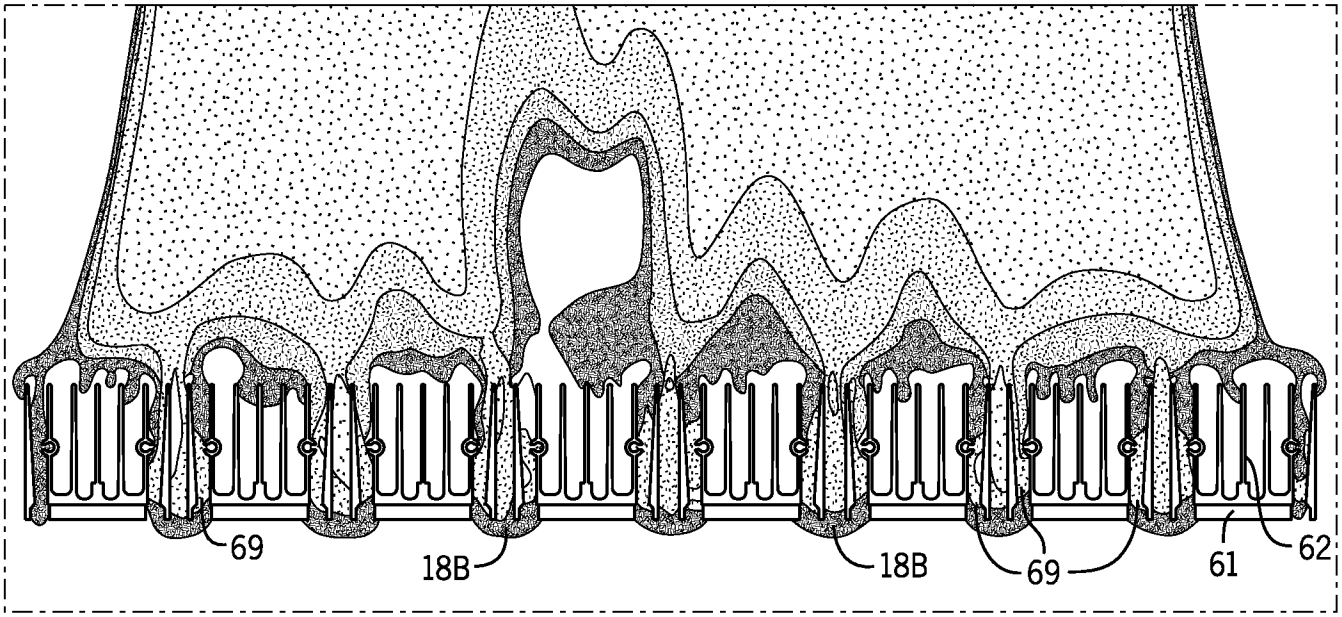
FIG. 18 is a fragmentary sectional view across the LED assembly of FIG. 17 illustrating simulated air-flow velocity through the channels.

FIG. 18 shows simulated velocity of air flow along LED assembly 60. The darker areas between heat sinks 62 and through venting apertures 69 illustrates increased air flow which facilitates heat removal from LED assembly 60.

While the principles of the invention have been shown and described in connection with specific embodiments, it is to be understood that such embodiments are by way of example and are not limiting.

The invention claimed is:

1. A mounting assembly for securing a light fixture to a static structure, the mounting assembly comprising:

a hollow bar having opposite bar ends and extending therebetween, each of the opposite bar ends being secured with respect to a main body portion of the light fixture, the hollow bar comprising exterior anti-rotational surface features including parallel flutes and grooves along a gripping region between the opposite bar ends and spaced from the main body portion of the light fixture; and a gripper attachable to the static structure and comprising first and second bar-engagement portions removably attached to each other, each of the bar-engagement portions having a semi-cylindrical bar-engaging surface with anti-rotational features including parallel flutes and grooves inter-engaged with and complementary to the exterior anti-rotational surface features along the gripping region of the hollow bar, the second bar-engagement portion being configured for attachment to the first bar-engagement portion to fully encircle and interlock with the gripping region of the hollow bar, the gripper being spaced from the opposite ends of the bar and the main body portion of the light fixture.

2. The mounting assembly of claim 1 being adjustable such that the light fixture is positionable to a selected one of a finite number of orientations.

3. The mounting assembly of claim 2 further comprising a guide indicating the angle for each of the orientations of the light fixture with respect to the static structure.

4. The mounting assembly of claim 3 wherein the guide is a bracket removably secured with respect to the hollow bar at a plurality of positions therealong.

5. The mounting assembly of claim 4 wherein:

the bracket is shaped to follow an outer shape of the bar and includes angle markings; and the gripper has a reference line which points to a particular one of the angle markings, thereby indicating the angle of the light fixture with respect to the static structure.

6. The mounting assembly of claim 1 wherein the hollow bar is extruded.

7. The mounting assembly of claim 1 wherein the light fixture includes at least one bar support projecting from the main body portion.

8. The mounting assembly of claim 7 wherein the first and second bar-engagement portions face one another with the hollow bar therebetween.

9. The mounting assembly of claim 8 wherein the hollow bar is substantially cylindrical.

10. The mounting assembly of claim 9 wherein the first bar-engaging portion is configured for attachment to the static structure.

11. The mounting assembly of claim 7 wherein the bar support includes a bar-support portion engaged with a corresponding one of the bar ends.

12. The mounting assembly of claim 7 wherein the bar-support portion is inserted into a corresponding one of the bar ends.

13. The mounting assembly of claim 12 being adjustable such that the light fixture is positionable to a selected one of a finite number of orientations.

14. The mounting assembly of claim 13 further comprising a guide indicating the angle of the light fixture with respect to the static structure.

15. The mounting assembly of claim 14 wherein the guide is a bracket removably secured with respect to the hollow bar which defines a plurality of positions for securing the bracket therealong.

16. The mounting assembly of claim 15 wherein:

the bracket is shaped to follow an outer shape of the hollow bar and includes angle markings; and the gripper has a reference line which points to a particular one of the angle markings, thereby indicating the angle of the light fixture with respect to the static structure.

17. The mounting assembly of claim 1 wherein the opposite bar ends comprise interior anti-rotational surface features shaped to prevent relative rotation of the hollow bar and the main body portion of the light fixture.

18. A light fixture comprising:

a main body portion and a mounting assembly for securement to a static structure;

at least one bar support projecting from the main body portion;

a hollow bar having opposite bar ends and extending therebetween, each of the opposite bar ends being supported by the bar support in a position along the main body portion, the hollow bar comprising a gripping region between the opposite bar ends and spaced from the main body portion, an exterior surface of the gripping region comprising exterior anti-rotational surface features; and a gripper assembly attachable to the static structure and including first and second bar-engagement portions removably attached to each other, each of the bar-engagement portions having a semi-cylindrical bar-engaging surface with anti-rotational features including parallel flutes and grooves inter-engaged with and complementary to the exterior anti-rotational surface features of the gripping region of the hollow bar, the second bar-engagement portion being configured for attachment to the first bar-engagement portion to fully encircle and interlock with the gripping region of the hollow bar extending through the gripper such that the gripper is spaced from the opposite bar ends and the main body portion.

19. The light fixture of claim 18 wherein the gripper and the hollow bar are configured for a finite number of the orientations which include positions of the gripper along the hollow bar.

20. The light fixture of claim 19 further comprising a guide indicating the angle of the light fixture with respect to the static structure.

21. The light fixture of claim 20 wherein the guide is a bracket removably secured with respect to the hollow bar which defines a plurality of positions for securing the bracket therealong.

22. The light fixture of claim 21 wherein:

the bracket is shaped to follow an outer shape of the hollow bar and includes angle markings; and the gripper has a reference line which points to a particular one of the angle markings, thereby indicating the angle of the light fixture with respect to the static structure.

23. The light fixture of claim 18 wherein the hollow bar is extruded.

24. The light fixture of claim 23 wherein the opposite bar ends comprise interior anti-rotational surface features shaped to prevent relative rotation of the hollow bar and the main body portion.

25. The light fixture of claim 23 wherein the hollow bar is substantially cylindrical.

26. The light fixture of claim 18 wherein the hollow bar is substantially cylindrical.

27. The light fixture of claim 26 wherein the first bar-engagement portion is configured for attachment to the static structure.

28. The light fixture of claim 27 wherein the first bar-engagement portion is configured for attachment atop a light pole.

29. The light fixture of claim 18 wherein the bar support includes a bar-support portion inserted into a corresponding one of the bar ends, a bar interior and the bar-support portion being shaped to prevent relative rotation.

* * * * *